US007331363B2

(12) United States Patent
Lanzi

(10) Patent No.: US 7,331,363 B2
(45) Date of Patent: Feb. 19, 2008

(54) TEXTILE WEAVE OF INELASTIC AND ELASTIC FIBER FORMING AN ELASTIC WEAVE WITH ONE OR MORE RIGID LOOPS

(75) Inventor: Enzo Lanzi, Sansepolcro AR (IT)

(73) Assignee: Lanzi S.R.L., Sansepolcro , AR (IT)

( * ) Notice: Subject to any disclaimer, the term of this patent is extended or adjusted under 35 U.S.C. 154(b) by 33 days.

(21) Appl. No.: 10/555,438

(22) PCT Filed: Jun. 14, 2004

(86) PCT No.: PCT/IT2004/000344

§ 371 (c)(1),
(2), (4) Date: Nov. 3, 2005

(87) PCT Pub. No.: WO2005/003417

PCT Pub. Date: Jan. 13, 2005

(65) Prior Publication Data

US 2007/0039661 A1 Feb. 22, 2007

(30) Foreign Application Priority Data

Jul. 3, 2003 (IT) ..... PG2003A0037

(51) Int. Cl.

| | |
|---|---|
| ***D03D 35/00*** | (2006.01) |
| ***D03D 3/02*** | (2006.01) |
| ***D03D 11/02*** | (2006.01) |
| ***D03D 15/08*** | (2006.01) |
| *D03D 15/00* | (2006.01) |

(52) U.S. Cl. ..... 139/422; 139/22; 139/384 R; 139/387 R; 139/426 R; 211/61

(58) Field of Classification Search ..... 139/22, 139/384 R, 387 R, 389, 390, 422, 426 R, 139/383 B See application file for complete search history.

(56) References Cited

U.S. PATENT DOCUMENTS

| | | | | |
|---|---|---|---|---|
| 1,838,991 | A * | 12/1931 | Goldsmith | 139/410 |
| 3,943,981 | A * | 3/1976 | De Brabander | 139/391 |
| 5,467,802 | A * | 11/1995 | Lusen et al. | 139/384 R |
| 5,662,147 | A * | 9/1997 | Haiber | 139/384 R |
| 6,085,802 | A * | 7/2000 | Silberberg | 139/387 R |

(Continued)

FOREIGN PATENT DOCUMENTS

| | | |
|---|---|---|
| FR | 2 153 189 | 5/1973 |

(Continued)

*Primary Examiner*—Gary L. Welch
*Assistant Examiner*—Robert H Muromoto, Jr.
(74) *Attorney, Agent, or Firm*—Young & Thompson

(57) ABSTRACT

Procedure consisting of the of textile weaving of inelastic and elastic fiber forming an elastic weave with one or more rigid loops. Field of application: clothing, footwear, headgear, haberdashery, costume jewelry, items for personal use, travel items, cases, leather goods and imitation leather goods. The inventive procedure consists of the weaving of an inelastic fiber and an elastic fiber, natural or synthetic, which are separated at preset intervals, in this way giving rise to one or more rigid loops that allow the application of laces or other objects that benefit from the combined effect of resistance and/or stability, provided by the loop in inelastic fiber, and of elasticity, provided by the inelastic-elastic weave.

9 Claims, 6 Drawing Sheets

U.S. PATENT DOCUMENTS

| | | | | |
|---|---|---|---|---|
| 6,349,750 | B1 * | 2/2002 | Fujiwara | 139/384 R |
| 2001/0003912 | A1 * | 6/2001 | Jackon et al. | 66/170 |
| 2002/0165495 | A1 * | 11/2002 | Bird et al. | 604/179 |
| 2003/0083603 | A1 * | 5/2003 | Nelson | 602/27 |
| 2003/0106346 | A1 * | 6/2003 | Matsumoto | 66/195 |
| 2004/0040640 | A1 * | 3/2004 | Bordes | 156/73.5 |
| 2006/0108386 | A1 * | 5/2006 | Lam | 224/158 |
| 2006/0162190 | A1 * | 7/2006 | Nishiwaki et al. | 36/97 |

FOREIGN PATENT DOCUMENTS

| | | |
|---|---|---|
| GB | 1 300 077 | 12/1972 |

* cited by examiner

TEXTILE WEAVE OF INELASTIC AND ELASTIC FIBER FORMING AN ELASTIC WEAVE WITH ONE OR MORE RIGID LOOPS

BACKGROUND OF THE INVENTION

A textile weave rigid in a width direction and elastic in a length direction provides in the fields of application (clothing, footwear, headgear, haberdashery, costume jewelry, items for personal use, travel items, cases, leather goods and imitation leather goods) a textile weave having one or more rigid loops that allow the application of laces or other objects that benefit from the combined effect of resistance and/or stability, provided by the loop in inelastic fiber, and of elasticity, provided by the inelastic-elastic weave.

BACKGROUND ART

There were no procedures of this type in the previous state of the art; i.e. there are no weaves of inelastic and elastic fiber and, all the more so, there are no procedures that with this weave that lead to the creation of one or more rigid loops obtained from the momentary interruption of the weave (FIG. 6).

By comparing FIG. 1 (lower part of weave not stretched) and FIG. 2 (lower part of weave stretched) the stretching, due to this weave of fiber, can be seen.

DISCLOSURE OF INVENTION

With reference to the drawing figures, "A" illustrates inelastic fiber (top layer), "B" illustrates elastic fiber (lower layer), and "C" illustrates textile weaving of the elastic fiber and the inelastic fiber (A+B).

The results achieved with this inventive procedure make it possible to apply the weave to various products. For example, the inventive textile weave in an athletic shoe (FIG. 3) may receive a lace. The lace is inserted into a loop formed of the inelastic fiber ("A") which in turn is connected to the inelastic-elastic weave ("C") at a first end thereof, with a second end of the inelastic-elastic weave ("C") being connected to another portion of the inelastic fiber ("A") which is secured to the athletic shoe.

In FIG. 4 the lace is in the resting position and the textile weaving portion "C" is contracted in the vertical direction.

When the lace is tightened (FIG. 5) the inelastic-elastic weave (textile weaving portion "C") stretches in the vertical direction, but the loop (of the inelastic fiber "A") does not stretch.

The invention, which is derived from this procedure, applied to the shoe makes it possible to make the shoe more comfortable, as the wearer can adjust the degree of tightness of the shoe to his or her own liking, and make it 'fit tighter to the foot' for athletic use or 'fit looser to the foot' for more relaxed situations.

DESCRIPTION OF THE PREFERRED EMBODIMENTS

Figure 1:
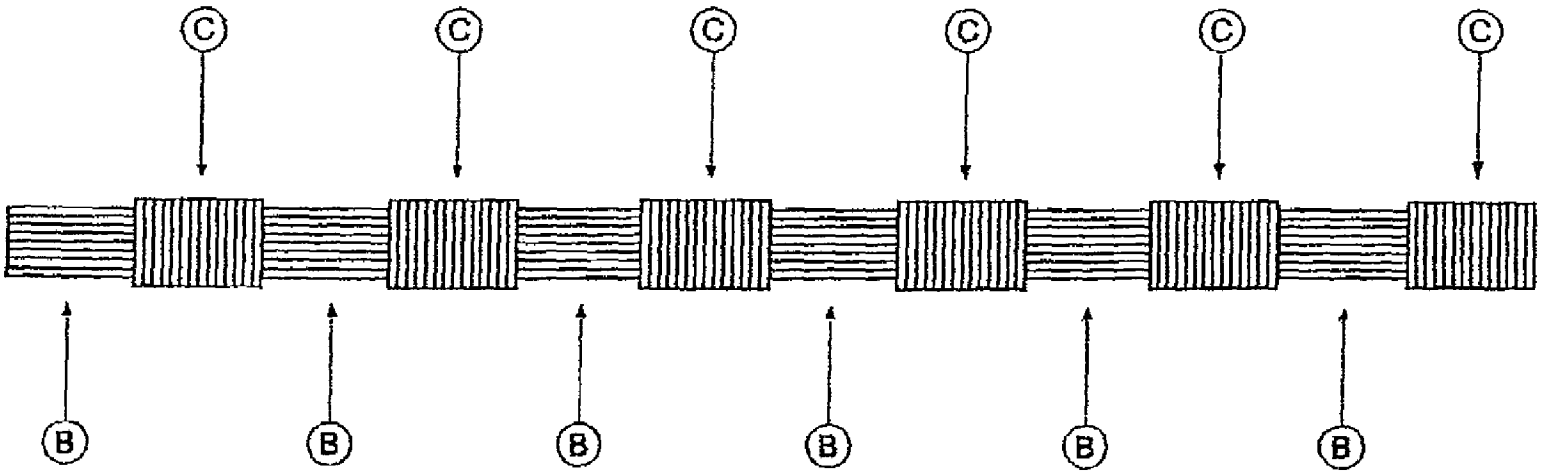
FIG. 1 illustrates the lower part "B" of the weave not stretched.
Figure 2:
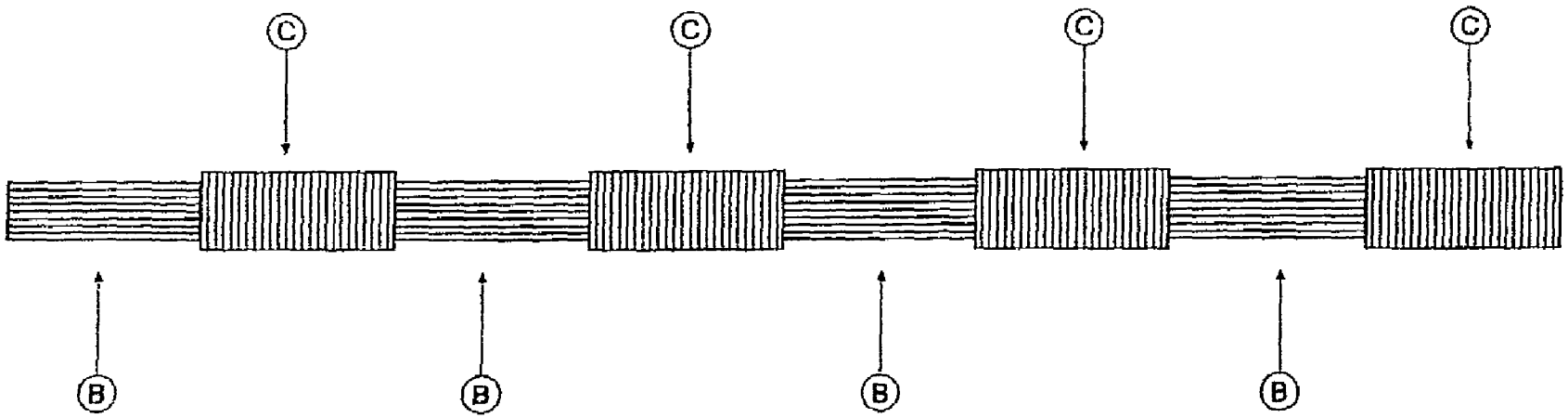
FIG. 2 illustrates the lower part "B" of the weave stretched.
Figure 3:
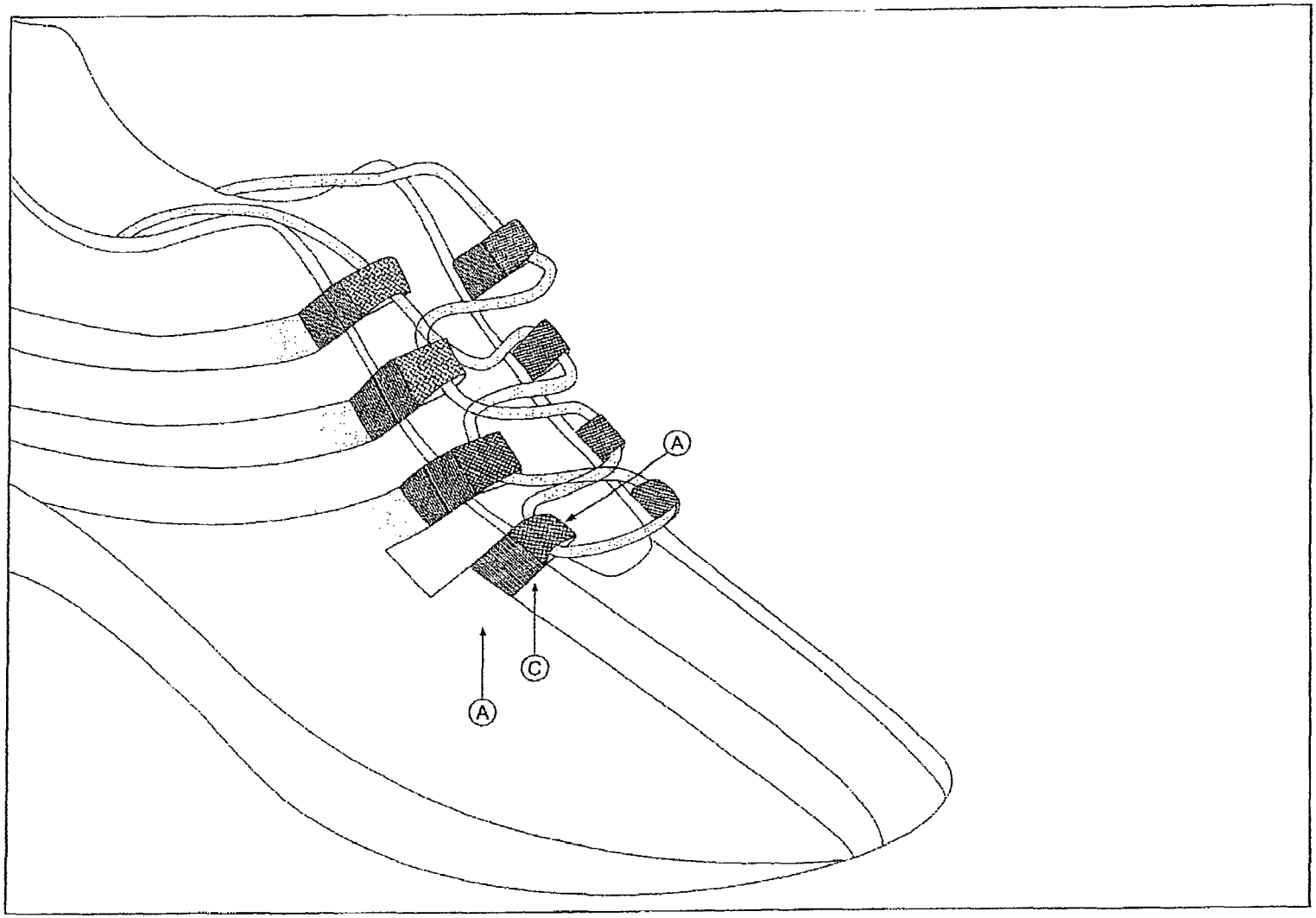
FIG. 3 illustrates application of the weave to an athletic shoe.
Figure 4:
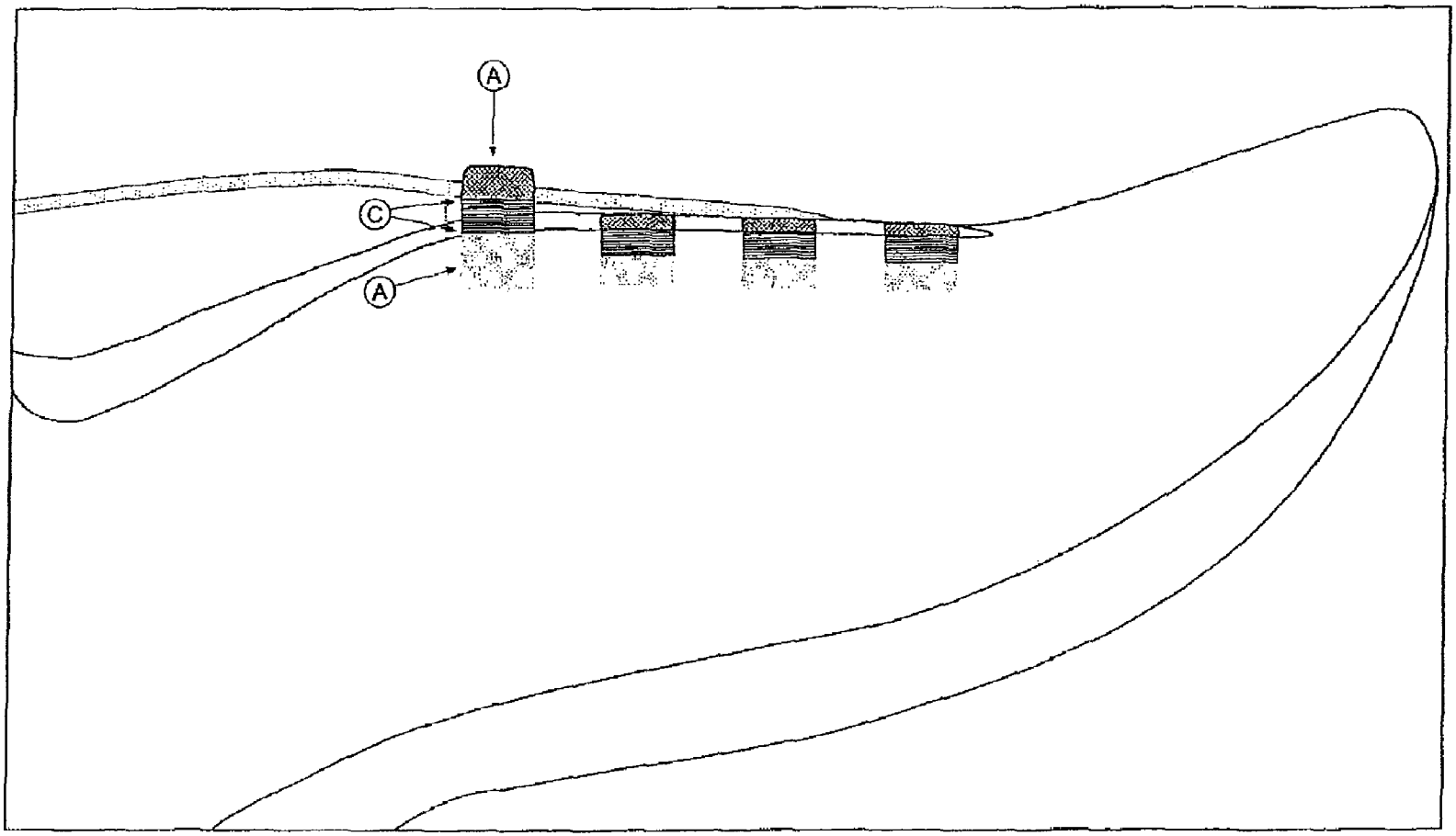
FIG. 4 illustrates the loop of the inelastic fiber "A" not subject to traction by the lace.
Figure 5:
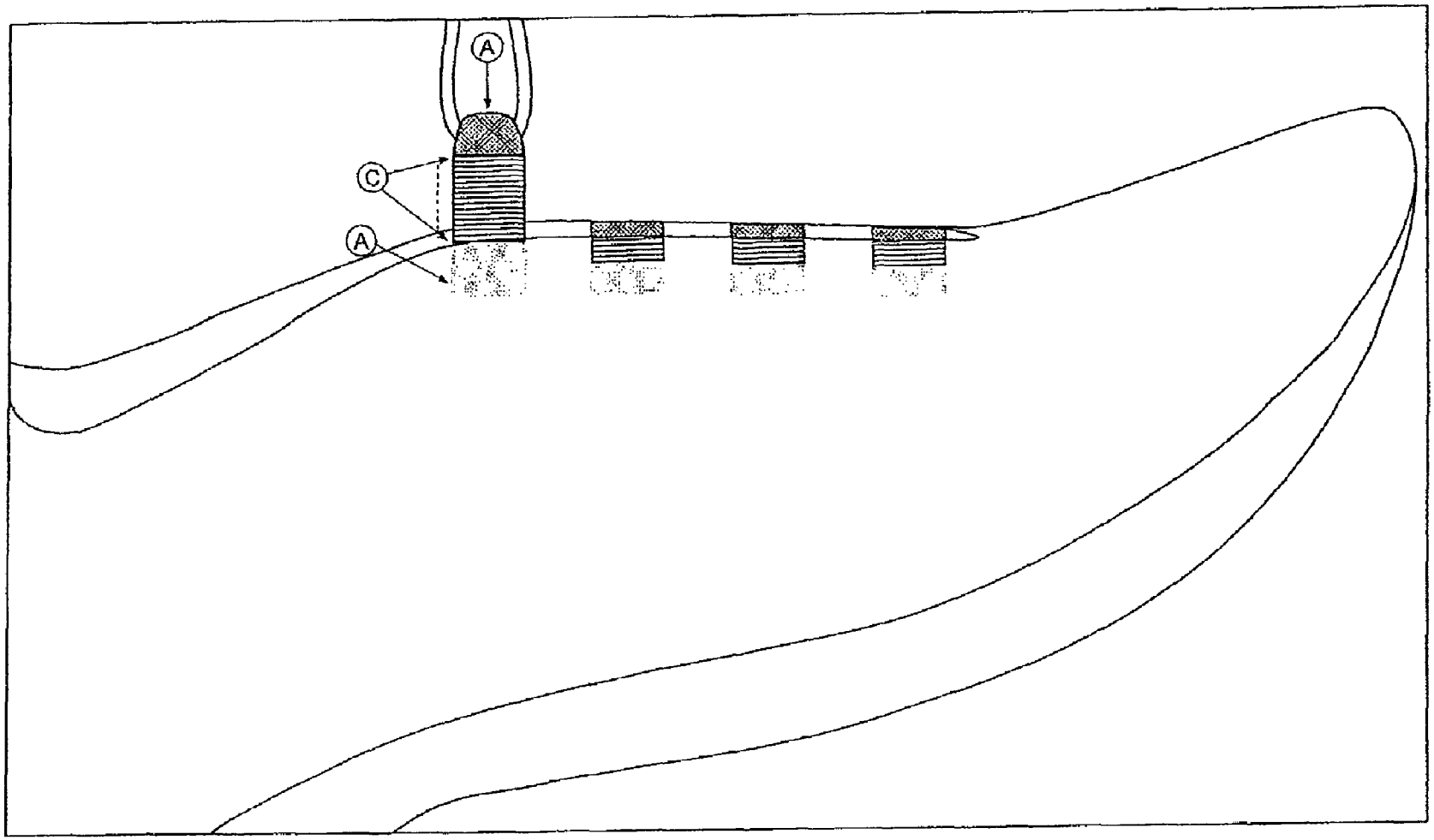
FIG. 5 illustrates the loop subject to traction by the lace.
Figure 6:
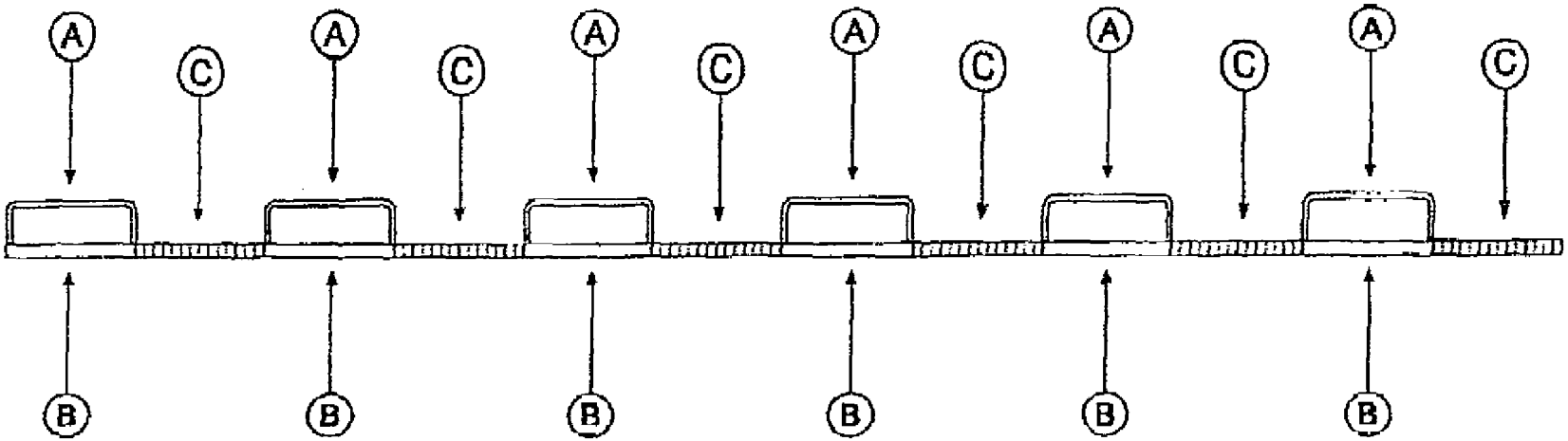
FIG. 6 illustrates a side view of the weave of inelastic and elastic fiber "C" with rigid loops "A".

Again, with reference to the drawing figures, "A" illustrates inelastic fiber (the upper layer), "B" illustrates elastic fiber (the lower layer), and "C" illustrates textile weaving of the elastic fiber and the inelastic fiber (A+B).

To carry out the invention it is necessary to use an automatic loom for weaving ribbons and upon which an inelastic warp is set up which constitutes the length of the ribbon, which serves for the structure of the rigid loop and for that of the elastic ribbon.

It must be combined also with an elastic warp.

A device is required which inserts a weft in the elastic ribbon, but alternates the inserting of another weft in the rigid loop only. A textile design is prepared such that while the inelastic warp with its weft weaves the loop, the elastic warp remains separated in the lower part of the ribbon.

The invention claimed is:

1. A method of weaving a textile weave, comprising the step of:

weaving an elastic ribbon with first regions separated, along a length direction of the ribbon, by second regions, the ribbon being elastic in the length direction, the first regions comprising an inelastic fiber, defining an upper layer of rigid loops, spaced apart from a lower layer of an elastic fiber, the second regions comprising elastic textile weavings of the elastic fiber and the inelastic fiber, including the sub-steps of i) setting an inelastic warp, constituting the length of the ribbon, upon a loom, the inelastic warp being the inelastic fiber of the textile weavings and the upper layer of rigid loops; and ii) weaving the inelastic warp with an elastic warp, the elastic warp being the elastic fiber of the textile weavings and the lower layer of elastic fiber separated from the upper layer of rigid loops, including inserting a first weft in the elastic ribbon at the first regions and a second weft at the second regions.

2. The method of claim 1, wherein, the elastic fiber is one of natural and synthetic fiber, and the inelastic fiber is one of natural and synthetic fiber.

3. The method of claim 1, comprising the further steps of:

dividing the ribbon into parts and attaching the second regions of the parts, with the elastic textile weavings, to an edge of a shoe so that the first regions, with the layer of rigid loops, accept laces.

4. The method of claim 1, wherein the layer of rigid loops define buttonholes.

5. The method of claim 4, wherein, the buttonholes shut when the ribbon is stretched in the length direction and the buttonholes open when the ribbon is released in the length direction.

6. The method of claim 1, wherein the layer of rigid loops define laceholes for laces of a shoe.

7. The method of claim 6, wherein, the laceholes shut when the ribbon is stretched in the length direction and the laceholes open when the ribbon is released in the length direction.

8. A method of weaving a textile weave, comprising the steps of:

i) providing an inelastic warp, of an inelastic fiber, constituting a length of a ribbon; and ii) weaving an inelastic warp with an elastic warp of an elastic fiber, including inserting a first weft in the elastic ribbon at first regions and a second weft at second regions, so that the second regions separate the first regions along the length of the ribbon, wherein, the ribbon is elastic in the length direction, the first regions comprise an upper layer of rigid loops of the inelastic fiber spaced apart from a lower layer of the elastic fiber, and the second regions comprise elastic textile weavings of the elastic fiber woven with the inelastic fiber.

9. A method of weaving a textile weave, comprising the step of:

weaving an inelastic warp of an inelastic fiber, constituting a length of a ribbon, with an elastic warp of an elastic fiber, to define the first regions separated by second regions along the length of the ribbon, wherein, the ribbon is elastic in the length direction, the first regions comprise an upper layer of rigid loops of the inelastic fiber spaced apart from a lower layer of the elastic fiber, and the second regions comprise elastic textile weavings of the elastic fiber woven with the inelastic fiber.

* * * * *